US010334665B2

(12) United States Patent
Kim

(10) Patent No.: US 10,334,665 B2
(45) Date of Patent: Jun. 25, 2019

(54) UNDERWATER HEATER AND MANUFACTURING METHOD THEREFOR

(71) Applicants: Gikyung Kim, Seoul (KR); KD HEATER CO., LTD., Yangju-si (KR)

(72) Inventor: Gikyung Kim, Seoul (KR)

(73) Assignee: KD HEATER CO., LTD., Gyeonggi-Do (KR)

( * ) Notice: Subject to any disclaimer, the term of this patent is extended or adjusted under 35 U.S.C. 154(b) by 2 days.

(21) Appl. No.: 15/117,908

(22) PCT Filed: Oct. 12, 2015

(86) PCT No.: PCT/KR2015/010706
§ 371 (c)(1),
(2) Date: Aug. 10, 2016

(87) PCT Pub. No.: WO2016/111444
PCT Pub. Date: Jul. 14, 2016

(65) Prior Publication Data

US 2018/0206293 A1 Jul. 19, 2018

(30) Foreign Application Priority Data

Jan. 9, 2015 (KR) ..... 10-2015-0003119

(51) Int. Cl.
*H05B 3/04* (2006.01)
*H05B 3/44* (2006.01)
*H05B 3/82* (2006.01)

(52) U.S. Cl.
CPC ..... *H05B 3/82* (2013.01); *H05B 3/04* (2013.01); *H05B 3/44* (2013.01)

(58) Field of Classification Search
CPC ... H05B 3/06; H05B 3/08; H05B 3/04; H05B 3/82; H05B 3/44; H05B 3/03;
(Continued)

(56) References Cited

U.S. PATENT DOCUMENTS 4,007,371 A * 2/1977 Njos ..... A01K 63/065 119/73
4,617,455 A * 10/1986 Schwarzkopf ..... H05B 3/48 219/523
(Continued)

FOREIGN PATENT DOCUMENTS

JP 2009283223 12/2009
JP 2013183696 9/2013
(Continued)

OTHER PUBLICATIONS

"Subcutaneous Transmitter (A3019)" by Hashemi, Web page <http://www.opensourceinstruments.com/Electronics/A3019/M3019.html>, p. 17, Oct. 30, 2014, retrieved from Internet Archive Wayback Machine on Aug. 14, 2018 <https://web.archive.org/web/20141030070331/http://www.opensourceinstruments.com/Electronics/A3019/M3019.html>.*
(Continued)

*Primary Examiner* — Dana Ross
*Assistant Examiner* — Michael S. Poetzinger
(74) *Attorney, Agent, or Firm* — Cantor Colburn LLP

(57) ABSTRACT

Provided is an immersion heater including: a flange; a heat generation tube bent in a U-shape and having both lengthwise ends passing through the flange in an upward direction; a sensor rod having one end passing through the flange in the upward direction; a cap coupled to the flange to cover an end of the heat generation tube and an end of the sensor rod protruding from a top surface of the flange; a power wire having one end inserted into the cap and connected to a power terminal of the heat generation tube; a sensor wire having one end inserted into the cap and connected to a sensor terminal of the sensor rod; and silicone filled in the cap and including a plurality of hardened layers with a time difference.

8 Claims, 8 Drawing Sheets

(58) Field of Classification Search
CPC ..... H05B 2203/016; H01R 12/52; H01R 12/523; H01R 13/523; H01R 33/965; H01R 43/005
USPC ..... 392/500, 451, 497; 219/541
See application file for complete search history.

(56) References Cited

U.S. PATENT DOCUMENTS 4,754,119 A * 6/1988 Knauss ..... G05D 23/275 219/511
5,934,934 A * 8/1999 Ward ..... H01R 13/5216 439/521
6,317,559 B1 * 11/2001 Kim ..... F24H 9/1818 392/398
8,872,025 B2 * 10/2014 Tamai ..... B62D 5/0406 174/50.5
2001/0046380 A1 * 11/2001 LeFebvre, Jr. ..... H05B 3/80 392/501
2002/0015585 A1 * 2/2002 Jensen ..... F24H 9/1818 392/485
2009/0088032 A1 * 4/2009 Keeven ..... H01R 4/36 439/797
2011/0042387 A1 * 2/2011 Henry ..... B65D 88/744 220/592.01

FOREIGN PATENT DOCUMENTS

KR 200346542 4/2004
KR 101213580 12/2012
KR 101219074 1/2013

OTHER PUBLICATIONS

"Subcutaneous Transmitter (A3019)" by Hashemi, Web page <http://www.opensourceinstruments.com/Electronics/A3019/M3019.html>, p. 17, Oct. 30, 2014, retrieved from Internet Archive Wayback Machine on Aug. 14, 2018 (Year: 2014).*
International Search Report—PCT/KR2015/010706 dated Feb. 2, 2016.

* cited by examiner

UNDERWATER HEATER AND MANUFACTURING METHOD THEREFOR

TECHNICAL FIELD

The present invention relates to an immersion heater installed to be immersed under the surface of water and a method of manufacturing the same, and more particularly, to an immersion heater in which a portion of a current supply wire connected to a heater terminal and a sensor terminal is completely waterproofed so that a phenomenon that water flows into the current supply wire, the heater terminal, or the sensor terminal can be prevented, and a method of manufacturing the same.

BACKGROUND ART

In general, a water tank in which live fishes are accommodated, should be maintained at a constant water temperature so that an inhabited environment of the live fishes can be maintained with good quality. It is not substantially possible to maintain the temperature of a space in which the water tank is installed, at a constant temperature. Thus, an immersion heater that maintains water in the water tank in a set temperature range is installed.

When briefly describing a general structure of the immersion heater, the immersion heater includes a heat generation tube for generating heat and a controller that controls an operation of the heat generation tube. Although the shape of the above-described heat generation tube varies according to a required heat generation condition or the size of the water tank, the heat generation tube is mostly wound in the form of a coil having a predetermined diameter, is formed in the range of a length at which the heat generation tube can be installed in the water tank, and is connected to the above-described controller. A water temperature detection sensor for detecting a water temperature and a heat generation tube detection sensor for detecting the temperature of the heat generation tube are respectively installed adjacent to the heat generation tube.

The above-described water temperature detection sensor and heat generation tube detection sensor are installed to detect the water temperature and the temperature of the heat generation tube and to stop an operation of the heat generation tube when the detected water temperature and temperature of the heat generation tube are out of an allowable range. For example, the above-described water temperature and heat generation tube detection sensors are configured to have a structure in which well-known sensing members for detecting heat are self-shorted due to the temperature of water or a solution in the heat generation tube or the water tank and a current applied to the heat generation tube is cut off by the above-described controller.

In this case, a power wire and a sensor wire, which are disposed to deliver currents and to transmit signals, are connected to the heat generation tube and the detection sensors. However, there is a problem that water flows into a portion into which the power wire and the sensor wire are inserted and a short circuit occurs. Thus, in the conventional immersion heater, the portion into which the power wire and the sensor wire are inserted should be placed on the surface of water. Thus, there is a limitation in utilization. In order to solve the problem, a scheme for sealing the portion into which the power wire and the sensor wire are inserted, with silicone or packing, has been suggested. However, in a currently-suggested sealing technique, the inflow of water along the power wire and the sensor wire cannot be completely prevented.

DISCLOSURE

Technical Problem

The present invention is directed to providing an immersion heater including a portion in which an electric wire and a terminal are connected to each other, can be completely sealed and several portions in which the electric wire and the terminal are connected to each other, can be sealed at one time so that productivity is very high, and a method of manufacturing the same.

Technical Solution

One aspect of the present invention provides an immersion heater including: a flange; a heat generation tube bent in a U-shape and having both lengthwise ends passing through the flange in an upward direction; a sensor rod having one end passing through the flange in the upward direction; a cap coupled to the flange to cover an end of the heat generation tube and an end of the sensor rod protruding from a top surface of the flange; a power wire having one end inserted into the cap and connected to a power terminal of the heat generation tube; a sensor wire having one end inserted into the cap and connected to a sensor terminal of the sensor rod; and silicone filled in the cap and including a plurality of hardened layers with a time difference.

Two or more heat generation tubes may be mounted on the flange, and each of the two or more heat generation tubes may be disposed to be spaced apart from each other.

Another aspect of the present invention provides a method of manufacturing an immersion heater, including: a first operation of preparing a heat generation tube bent in a U-shape and a sensor rod; a second operation of passing both lengthwise sides of the heat generation tube and one lengthwise side of the sensor rod through a flange using a fit technique and then connecting a power wire to a power terminal disposed on each of both lengthwise sides of the heat generation tube and connecting a sensor wire to one lengthwise side of the sensor rod; a third operation of coupling a cap to the flange to cover both lengthwise ends of the heat generation tube and one lengthwise end of the sensor rod; a fourth operation of injecting silicone into the cap through an injection hole formed in a ceiling surface of the cap, wherein silicone is injected at a plurality of times with a set time difference; and a fifth operation of fastening a bolt into the injection hole to close the injection hole.

The fourth operation may be performed by injecting silicone at a plurality of times with a time difference of 24 hours.

In the fourth operation, an amount of silicone to be first injected may be an amount such that a point at which the heat generation tube and the power wire are connected to each other and a point at which the sensor rod and the sensor wire are connected to each other, are capable of being buried.

The flange and the cap may be coupled to each other in a screw coupling structure, and the second operation may further include welding a portion of a top surface of the flange through which the heat generation tube and the sensor rod pass, and the third operation may further include welding between the top surface of the flange and a bottom end of an outside surface of the cap.

Advantageous Effects

In an immersion heater according to the present invention, a portion in which an electric wire and a terminal are connected to each other is completely sealed so that the immersion heater can be used in a state in which it is fully immersed in water. Also, by using a method of manufacturing the immersion heater according to the present invention, the portion in which the electric wire and the terminal are connected to each other can be completely sealed only through the injection of silicone and all of several portions in which the electric wire and the terminal are connected to each other can be sealed at one time so that productivity of the immersion heater can be improved.

MODES OF THE INVENTION

Hereinafter, a method of manufacturing an immersion heater according to an embodiment of the present invention will be described in detail with reference to the attached drawings.

Figure 1:
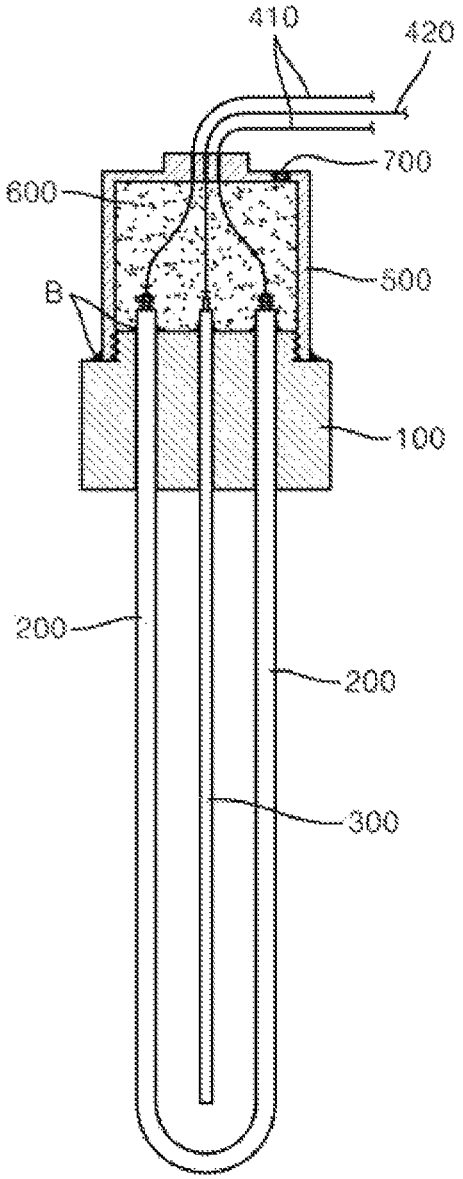
FIG. 1 is a cross-sectional view of an immersion heater according to the present invention.

FIG. 1 is a cross-sectional view of an immersion heater according to the present invention.

The immersion heater according to the present invention that is a kind of an electric heating device for heating water filled in a water tank using a current supplied from the outside, is characterized by having a complete waterproof structure in which a short circuit does not occur due to water that flows into the immersion heater even though the whole of the immersion heater is immersed in water. That is, the immersion heater according to the present invention includes a flange 100 that serves as a body, a heat generation tube 200 and a sensor rod 300, which are mounted to pass through the flange 100 in an upward direction, a cap 500 coupled to the flange 100 to cover an end of the heat generation tube 200 and an end of the sensor rod 300 that protrude toward a top surface of the flange 100, a power wire 410 having one end inserted into the cap 500 and connected to a power terminal 210 of the heat generation tube 200, a sensor wire 420 having one end inserted into the cap 500 and connected to a sensor terminal 310 of the sensor rod 300, and silicone 600 filled in the cap 500 and stacked in the form of a plurality of layers, as illustrated in FIG. 1.

The heat generation tube 200 is configured to be bent in a U-shape, to have both lengthwise ends coupled to each other to pass through the flange 100 in the upward direction, and to generate heat due to a current delivered from the power wire 410. The sensor rod 300 is configured to deliver signals for turning on/off the heat generation tube 200 according to a water temperature to a controller (not shown) so as to prevent a phenomenon that water in a water tank is overheated. In this way, the heat generation tube 200 for generating heat and the sensor rod 300 for generating a control signal for the heat generation tube 200 according to the water temperature are substantially applied to the conventional immersion heater. Thus, detailed descriptions thereof will be omitted.

In this case, the feature of a configuration of the immersion heater according to the present invention is that an inside of the cap 500 for covering the power terminal 210 and the sensor terminal 310 is filled with silicone 600 so as to prevent a phenomenon that water in the water tank flows into the power terminal 210 or the sensor terminal 310 along the power wire 410 and the sensor wire 420. That is, because, in the conventional immersion heater, waterproofing is performed only at an inlet of a hole into which the power wire 410 and the sensor wire 420 are inserted, when a waterproof material coated on the inlet of the hole into which the power wire 410 and the sensor wire 420 are inserted, is damaged, water in the water tank flows into the power terminal 210 or the sensor terminal 310 so that a short circuit occurs. However, the immersion heater according to the present invention has an advantage that the whole of a space in which the power wire 410 and the sensor wire 420 are connected to the power terminal 210 and the sensor terminal 310, as well as the hole into which the power wire 410 and the sensor wire 420 are inserted, are filled with silicone 600 so that a phenomenon that water flows into the power terminal 210 or the sensor terminal 310 does not occur.

Meanwhile, when silicone 600 for filling the cap 500 is injected once and then is hardened, silicone may be spaced apart a very short distance from the power wire 410 or the sensor wire 420 when silicone 600 is contracted during the hardening operation, or silicone 600 may be spaced apart a very short distance from an inside surface of the cap 500. In this way, when a separation space is formed between the power wire 410 and the silicone 600, between the sensor wire 420 and the silicone 600 and between the inside surface of the cap 500 and the silicone 600, water in the water tank may flow into the power terminal 210 or the sensor terminal 310 through the separation space and may be in contact with the power terminal 210 or the sensor terminal 310.

In order to solve the above-described problem, the immersion heater according to the present invention is characterized in that, when silicone 600 is injected into the cap 500, the cap 500 is not filled with silicone 600 at one time but silicone 600 is injected into the cap 500 at several times with a predetermined time difference. An operation of injecting silicone 600 into the cap 500 at several times and effects thereof will be described in detail with reference to FIGS. 2 through 6.

FIGS. 2 through 6 are cross-sectional views sequentially showing an operation of manufacturing an immersion heater according to the present invention.

Figure 2:
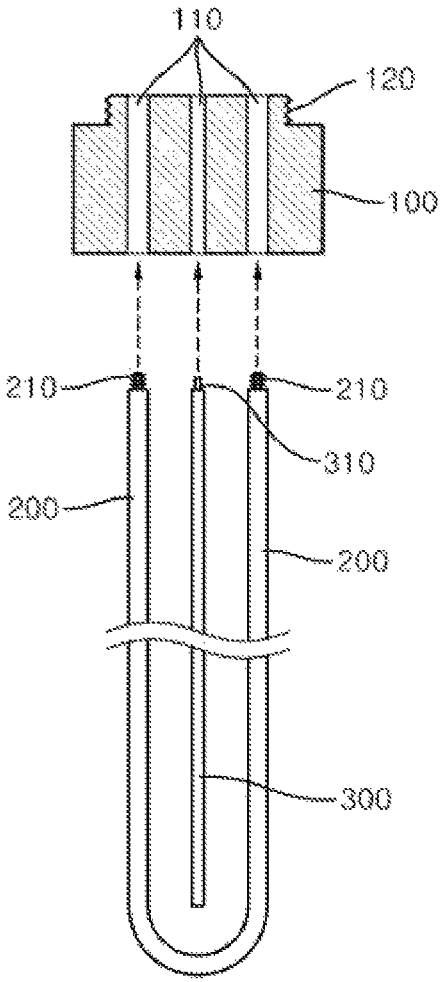
FIGS. 2 through 6 are cross-sectional views sequentially showing an operation of manufacturing an immersion heater according to the present invention.
Figure 3:
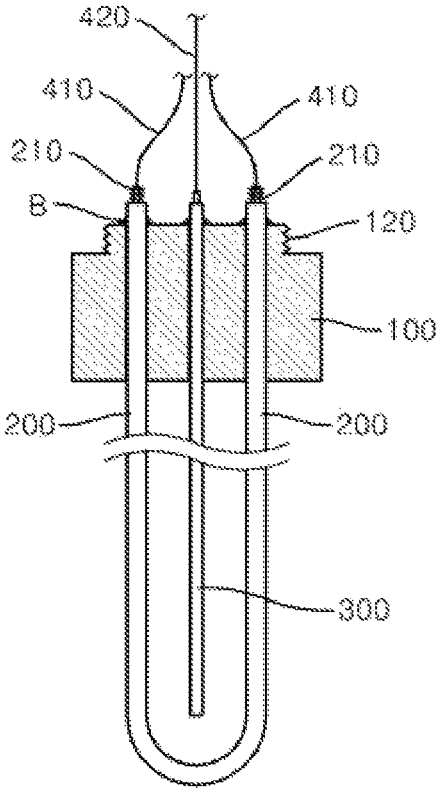

When the immersion heater is manufactured by a method of manufacturing the immersion heater according to the present invention, first, after the heat generation tube 200 bent in the U-shape and the sensor rod 300 are prepared, as illustrated in FIG. 2, both lengthwise sides of the heat generation tube 200 and one lengthwise side of the sensor rod 300 pass through the flange 100 using a fit technique through an insertion hole 110 formed in the flange 100. When the heat generation tube 200 and the sensor rod 300 are simply inserted into the insertion hole 110, the heat generation tube 200 and the sensor rod 300 may be detached and removed from the flange 100 due to an external force. Thus, a portion of a top surface of the flange 100 through which the heat generation tube 200 and the sensor rod 300 pass, is welded to form welded beads B, as illustrated in FIG. 3. When the heat generation tube 200 and the sensor rod 300 are stably coupled to the flange 100, the power wire 410 is connected to the power terminal 210 disposed at each of both lengthwise sides of the heat generation tube 200, and the sensor wire 420 is connected to one lengthwise side of the sensor rod 300.

Figure 4:
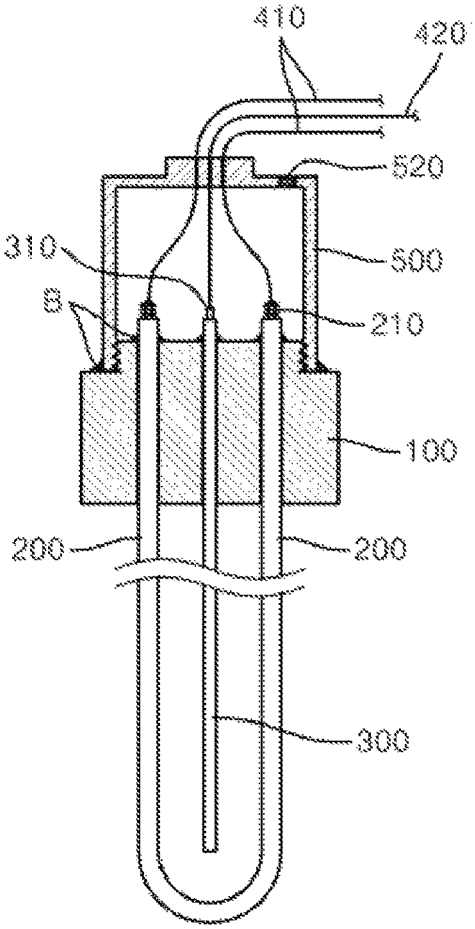

When connection of the power wire 410 and the sensor wire 420 is completed, as illustrated in FIG. 4, the cap 500 is coupled to the flange 100 to cover both lengthwise ends of the heat generation tube 200 and one lengthwise end of the sensor rod 300. In this case, the power wire 410 and the sensor wire 420 pass through the cap 500 and are drawn toward an outside of the cap 500. When a female screw thread 510 formed on a bottom end of the inside surface of the cap 500 is screw-coupled to a male screw thread 120 formed at an upper side of the flange 100, the cap 500 is integrally coupled to the flange 100. An additional welding operation may be added so that screw coupling between the cap 500 and the flange 100 is not loose due to vibration or shock applied from the outside. Due to the welding operation, the welding beads B are formed between the top surface of the flange 100 and a bottom end of an outside surface of the cap 500. Thus, the flange 100 and the cap 500 are completely integrally coupled to each other, and a coupled portion therebetween is completely sealed. In this case, for improvements in a sealing property of a welded portion, preferably, the flange 100 and the cap 500 are welded by Argon welding in which the welded portion is smooth and a worker can do work while seeing the welded portion with naked eyes.

When coupling of the flange 100 and the cap 500 is completed, silicone 600 is injected into the cap 500 through an injection hole 520 formed in a ceiling surface of the cap 500 so that a connection portion of the power wire 410 and the heat generation tube 200 and a connection portion of the sensor wire 420 and the sensor rod 300 can be sealed. In this case, when the whole of the cap 500 is filled with silicone 600 by injecting silicone 600 at one time, silicone 600 is contracted while being hardened. Thus, a minute separation space may be formed, and through the separation space, water in the water tank flows into the cap 500 so that there is a possibility that a short circuit will occur.

Figure 5:
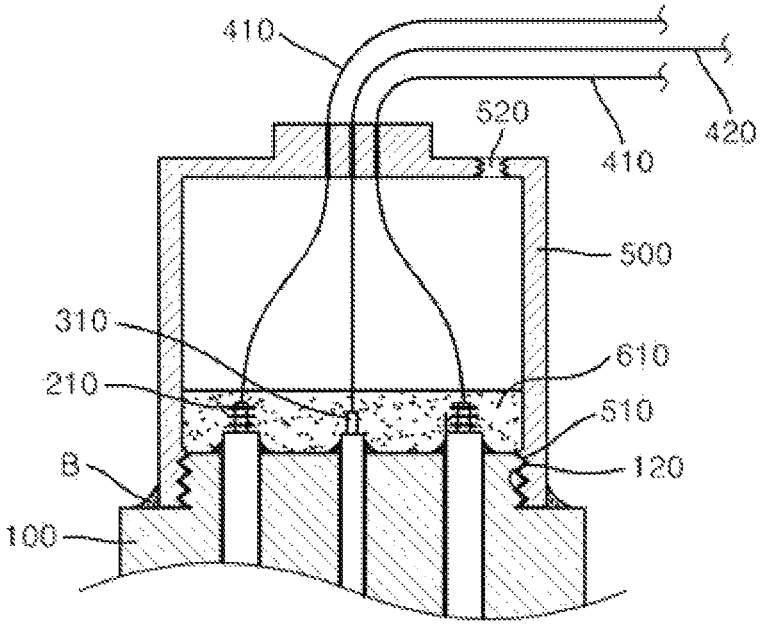
Figure 6:
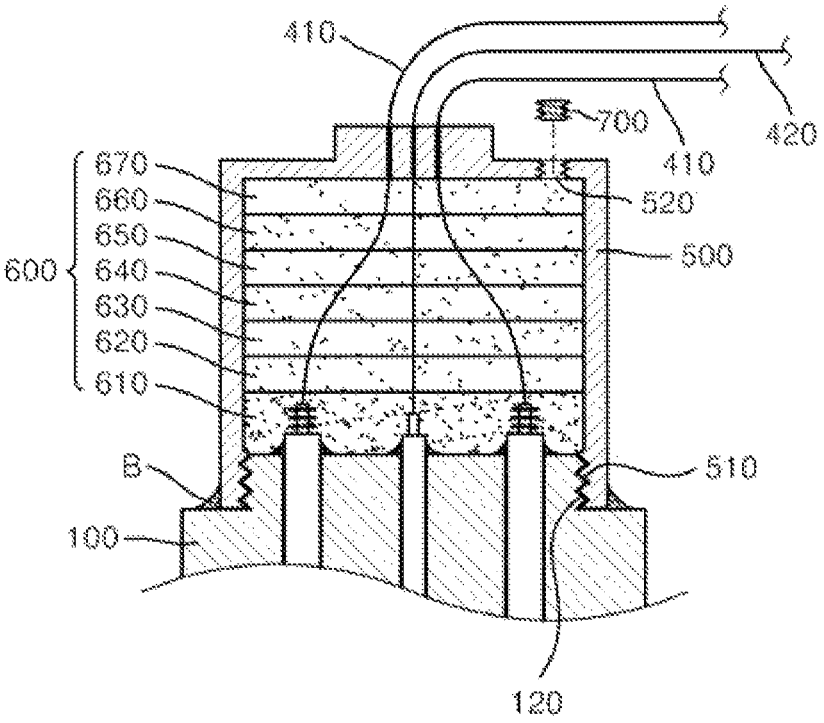

Thus, when silicone 600 is injected into the cap 500, as illustrated in FIG. 5, only a predetermined amount of silicone 600 is injected into the cap 500 so that a first silicone layer 610 having a predetermined thickness can be formed, and then, an operation of waiting until injected silicone 600 is hardened and then injecting silicone 600 having a predetermined amount into the cap 500 is repeatedly performed at several times so that a plurality of silicone layers 610 to 670 can be formed, as illustrated in FIG. 6.

In this way, silicone 600 is injected into the cap 500 with a set time difference at several times so that, when the plurality of silicone layers 610 to 670 are formed, each of the silicone layers 610 to 670 has a different environment condition at a hardening time. Thus, contracted patterns of the silicone layers 610 to 670 are different from each other. That is, even when part of the silicone layers 610 to 670 is spaced apart from the power wire 410 and the sensor wire 420, the other part thereof are closely adhered to the power wire 410 and the sensor wire 420, and even when another part of the silicone layers 610 to 670 is spaced apart from the inside surface of the cap 500, the other part thereof is closely adhered to the inside surface of the cap 500. Thus, neither a phenomenon that water flows into the cap 500 along the power wire 410 and the sensor wire 420, nor a phenomenon that water flows into the cap 500 along an inner wall of the cap 500, occurs.

In addition, even when a gap is formed while a previously-injected silicone layer is hardened, silicone 600 in a gel state to be subsequently injected fills the gap. Thus, the inside of the cap 500 can be filled with silicone 600 so that a waterproof performance can be remarkably improved. In this case, a hardening time for silicone 600 is generally about 24 hours. Thus, preferably, second silicone 600 is injected after about 24 hours elapse since first silicone 600 has been injected. That is, as illustrated in the current embodiment, when silicone 600 filled in the cap 500 includes seven silicone layers silicone 600 has to be injected for seven days.

Meanwhile, when the amount of silicone 600 to be first injected is not sufficient to bury both the power terminal 210 and the sensor terminal 310, i.e., when a connection portion of the power wire 410 and the power terminal 210 or a connection portion of the sensor wire 420 and the sensor terminal 310 is located at a higher position than a top surface of a first silicone layer 610, the connection portion of the power wire 410 and the power terminal 210 or the connection portion of the sensor wire 420 and the sensor terminal 310 may be damaged while hardening of the first silicone layer 610 is waited. Also, when the power terminal 210 and the sensor terminal 310 are buried with the first silicone layer 610 and ends (bottom ends in FIG. 6) of the power wire 410 and the sensor wire 420 are buried with a second silicone layer 620, a hardened pattern of the first silicone layer 610 and a hardened pattern of the second silicone layer 620 are different from each other so that the power wire 410 and the sensor wire 420 may be separated from the power terminal 210 and the sensor terminal 310.

Thus, preferably, the amount of silicone 600 to be first injected is set to an amount such that a point at which the heat generation tube 200 and the power wire 410 are connected to each other and a point at which the sensor rod 300 and the sensor wire 420 are connected to each other, can be buried.

Also, when injection of silicone 600 is completed, a bolt 700 is fastened into the injection hole 520 formed in the cap 500 so that the injection hole 520 can be closed. In this case, preferably, the bolt 700 is a stripper bolt so that the bolt 700 does not protrude toward an outside of the cap 500.

Figure 7:
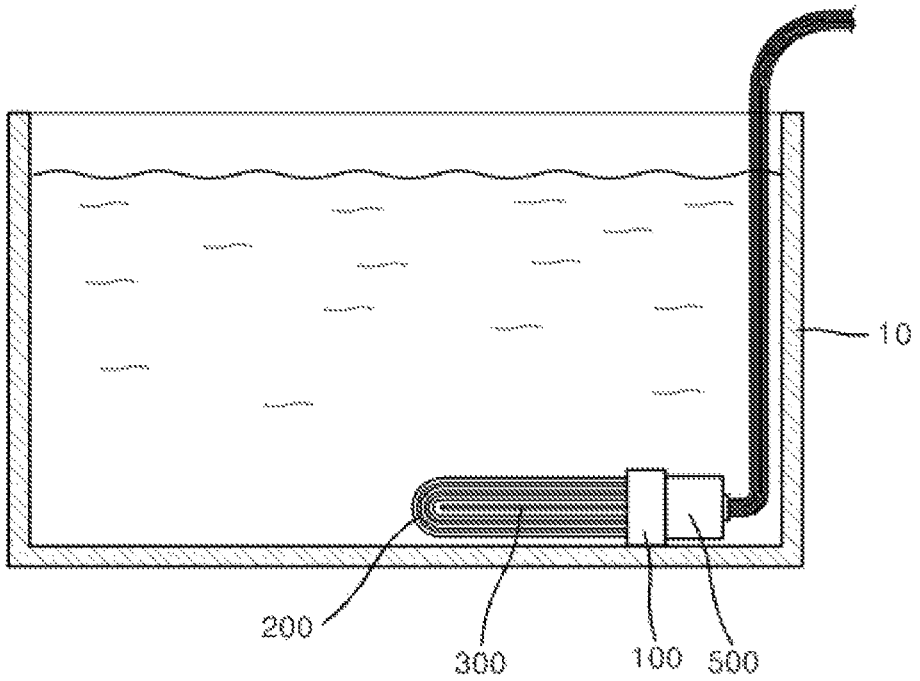
FIG. 7 is a view showing the stage of use of the immersion heater according to the present invention.
Figure 8:
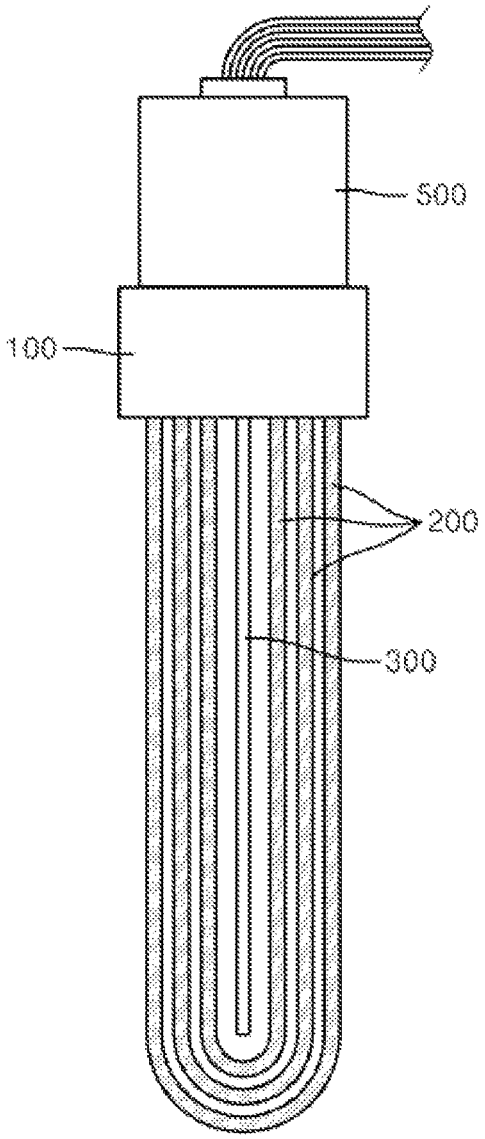
FIG. 8 is a view of an immersion heater according to a second embodiment of the present invention.

FIG. 7 is a view showing the stage of use of the immersion heater according to the present invention, and FIG. 8 is a view of an immersion heater according to a second embodiment of the present invention.

In the immersion heater according to the present invention manufactured by the method of manufacturing the immersion heater, both a point at which the power wire 410 is connected to the heat generation tube 200 and a point at which the sensor wire 420 is connected to the sensor rod 300, are completely sealed. Thus, the immersion heater may be used while being put on the bottom of a water tank 10, as illustrated in FIG. 7. Also, even when water in a water tank is somewhat reduced, the immersion heater is maintained in an immersed state until water in the water tank drains completely. Thus, a problem that the heat generation tube 200 is locally heated can be prevented. Thus, the problem caused by local heating does not occur in the immersion heater according to the present invention. Thus, as illustrated in FIG. 8, two or more heat generation tubes 200 are inserted into one flange 100 so that the entire heat generation capacity can be increased.

In FIG. 8, only a case where three heat generation tubes 200 are mounted on one flange 100 is illustrated. However, the number of mounting the heat generation tube 200 may be changed in various ways. Also, the heat generation tube 200 is not limited to the U-shape illustrated in the current embodiment but may be changed in various shapes. Of course, when a plurality of heat generation tubes 200 are mounted on one flange 100, the heat generation tubes 200 have to be installed to be spaced apart from each other so as to prevent overheating.

Meanwhile, even when a plurality of heat generation tubes 200 are mounted on one flange 100, as mentioned above, all portions in which the power wire 410 is connected to each of the heat generation tubes 200, are sealed through the injection of silicone 600 at one time. Thus, the effect of improving productivity of the immersion heater can be attained.

INDUSTRIAL APPLICABILITY

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. An immersion heater comprising:

a flange (100);

a heat generation tube (200) bent in a U-shape and having both lengthwise ends passing through the flange (100) in an upward direction;

a sensor rod (300) having one end passing through the flange (100) in the upward direction;

a cap (500) coupled to the flange (100) to cover an end of the heat generation tube (200) and an end of the sensor rod (300) protruding from a top surface of the flange (100);

a power wire (410) having one end inserted into the cap (500) and connected to a power terminal (210) of the heat generation tube (200);

a sensor wire (420) having one end inserted into the cap (500) and connected to a sensor terminal (310) of the sensor rod (300); and silicone (600) filled in the cap (500) and comprising a plurality of hardened layers with a time difference, wherein silicone filled in the cap comprises a plurality of silicone layers stacked in the upward direction.

2. The immersion heater of claim 1, wherein two or more heat generation tubes (200) are mounted on the flange (100), and each of the two or more heat generation tubes (200) are disposed to be spaced apart from each other.

3. The immersion heater of claim 1, wherein:

a first hardened silicone layer closest to the flange (100) is spaced apart from at least one of the power wire (410) or the sensor wire (420); and another one of the plurality of hardened layers is closely adhered to the at least one of the power wire (410) or the sensor wire (420).

4. A method of manufacturing an immersion heater, the method comprising:

a first operation of preparing a heat generation tube (200) bent in a U-shape and a sensor rod (300);

a second operation of passing both lengthwise sides of the heat generation tube (200) and one lengthwise side of the sensor rod (300) through a flange (100) and then connecting a power wire (410) to a power terminal (210) disposed on each of both lengthwise sides of the heat generation tube (200) and connecting a sensor wire (420) to one lengthwise side of the sensor rod (300);

a third operation of coupling a cap (500) to the flange (100) to cover both lengthwise ends of the heat generation tube (200) and one lengthwise end of the sensor rod (300);

a fourth operation of injecting silicone (600) into the cap (500) through an injection hole (520) formed in a ceiling surface of the cap (500), wherein silicone (600) is injected at a plurality of times with a set time difference; and a fifth operation of fastening a bolt (700) into the injection hole (520) to close the injection hole (520), wherein the fourth operation comprises forming a stack of silicone layers in a direction from the flange (100) to the injection hole (520).

5. The method of claim 4, wherein the fourth operation is performed by injecting silicone (600) at a plurality of times with a time difference of 24 hours.

6. The method of claim 5, wherein, in the fourth operation, an amount of silicone (600) to be first injected is an amount such that a point at which the heat generation tube (200) and the power wire (410) are connected to each other and a point at which the sensor rod (300) and the sensor wire (420) are connected to each other, are capable of being buried.

7. The method of claim 4, wherein the flange (100) and the cap (500) are coupled to each other in a screw coupling structure, and the second operation further comprises welding a portion of a top surface of the flange (100) through which the heat generation tube (200) and the sensor rod (300) pass, and the third operation further comprises welding between the top surface of the flange (100) and a bottom end of an outside surface of the cap (500).

8. The method of claim 4, wherein:

a first hardened silicone layer closest to the flange (100) is spaced apart from at least one of the power wire (410) or the sensor wire (420); and another one of the plurality of hardened layers is closely adhered to the at least one of the power wire (410) or the sensor wire (420).

* * * * *